US006273608B1

(12) United States Patent
Ward, Jr. et al.

(10) Patent No.: US 6,273,608 B1
(45) Date of Patent: Aug. 14, 2001

(54) STERILE COLLECTION BAG AND METHOD OF OPENING USING WIRE MECHANISMS

(75) Inventors: N. Robert Ward, Jr., Woodinville; Debra K. Cory, Shoreline; Geoffrey S. Bright, Bothell, all of WA (US)

(73) Assignee: International BioProducts Incorporated, Bothell, WA (US)

( * ) Notice: Subject to any disclaimer, the term of this patent is extended or adjusted under 35 U.S.C. 154(b) by 0 days.

(21) Appl. No.: 09/608,952

(22) Filed: Jun. 30, 2000

(51) Int. Cl.[7] ..... B65D 33/00

(52) U.S. Cl. ..... 383/33; 383/35; 383/203; 383/207; 383/209; 383/89; 383/91

(58) Field of Search ..... 383/33, 35, 203, 383/204, 207, 209, 86, 89, 91

(56) References Cited

U.S. PATENT DOCUMENTS

| | | | | |
|---|---|---|---|---|
| 488,783 | * | 12/1892 | Weber | 383/35 X |
| 2,973,131 | | 2/1961 | Mead et al. . | |
| 3,189,253 | | 6/1965 | Mojonnier . | |
| 3,526,317 | * | 9/1970 | Vanders | 383/209 X |
| 3,536,189 | * | 10/1970 | Gallagher | 383/91 X |
| 3,542,190 | * | 11/1970 | Keller | 383/91 X |
| 3,545,668 | * | 12/1970 | Hultberg | 383/35 X |
| 3,567,074 | * | 3/1971 | Brown | 383/91 X |
| 3,865,304 | | 2/1975 | Mojonnier et al. . | |
| 4,356,954 | | 11/1982 | Mojonnier . | |
| 5,000,500 | * | 3/1991 | Almog | 383/89 X |
| 5,132,124 | * | 7/1992 | Tamaki et al. | 383/33 X |
| 5,174,658 | | 12/1992 | Cook et al. . | |
| 5,180,229 | | 1/1993 | Niemeyer . | |
| 5,184,896 | | 2/1993 | Hammond et al. . | |
| 5,564,829 | | 10/1996 | Lafond . | |
| 5,669,715 | | 9/1997 | Dobreski et al. . | |
| 5,692,835 | * | 12/1997 | Krajeski | 383/89 X |
| 5,715,943 | | 2/1998 | Thompson, Jr. . | |

FOREIGN PATENT DOCUMENTS

| | | | | |
|---|---|---|---|---|
| 201257 | * | 11/1986 | (EP) | 383/203 |

* cited by examiner

*Primary Examiner*—Allan N. Shoap
*Assistant Examiner*—Robin Hylton
(74) *Attorney, Agent, or Firm*—Christensen O'Connor Johnson Kindness PLLC

(57) ABSTRACT

A sterile collection bag and method of opening using wire mechanisms. The bag includes a body and an opening mechanism. The body is formed of opposed side walls and an upper body end. The interior of the body defines a sterile collection space for an object. The opening mechanism includes first and second flexible metal strips each having a first end, a second end, and a mid-section. The mid-section of each metal strip is attached to the center section of a side wall. The metal strips are longer than the width of the body so as to extend beyond the side wall edges. The ends of the metal strips are unattached to one another. In one embodiment, the upper end of the body includes an opening. In another embodiment, the body includes a lateral tear line located below the body upper end, with the opening mechanism located below the tear line. During use, the ends of the metal strips are bent away from one another; the ends are pinched together and moved toward one another to cause the metal strips to bulge outward at their mid-section. This further causes the body side walls to separate so that the object may be inserted into the bag. When using a lateral tear line, the upper end of the body is first torn away along the lateral tear line.

19 Claims, 1 Drawing Sheet

STERILE COLLECTION BAG AND METHOD OF OPENING USING WIRE MECHANISMS

FIELD OF THE INVENTION

This invention relates to a special receptacle or package, and more particularly to reclosable sterile collection bags having wire closure mechanisms.

BACKGROUND OF THE INVENTION

Bags having wire closures are currently used to obtain industrial and chemical material samples in a sterile manner. For example, U.S. Pat. No. 2,973,131 describes a collection bag having metal wires. Strips of pressure sensitive tape are used to attach the metal wires to opposite side of the bag. Both the metal strips and the tape extend beyond the width of the bag. During use, the bag is filled, the opening is rolled closed, and the metal wires are folded back to clamp the rolled end. This arrangement has a number of disadvantages. Particularly, it is difficult to open and the clamped metal wire ends tend to puncture the bag during transport.

Later inventions have been made to help improve the ease at which the bag may be opened. For example, U.S. Pat. Nos. 3,189,253; 4,356,954; and 5,180,229 each use a center pull tab. While effective, such tabs are often more difficult to manufacture. Later inventions have also attempted to reduce puncturing during transport. U.S. Pat. No. 4,356,954 uses downwardly-directed strip ends. U.S. Pat. No. 5,180,229 encloses the wire ends with an additional length of covering material. As with the pull tabs, these arrangements are more difficult and more costly to manufacture.

Thus, a need yet exists for a sterile collection bag that avoids the problems of the prior art sterile collection bags. Ideally, such a bag would be easy to open and easy to manufacture. In addition, the components of such a bag would not cause punctures to the bag body during transport. The present invention is directed to fulfilling these needs and others as described below.

SUMMARY OF THE INVENTION

In accordance with aspects of the present invention, a sterile collection bag and method of opening is provided. The bag includes a body and an opening mechanism. The body is formed of opposed side walls and includes an upper body end. The interior of the body defines a sterile collection space for an object. The opening mechanism includes first and second flexible metal strips each having a first end, a second end, and a mid-section. The metal strips are attached to the side walls and are longer than the width of the body so as to extend beyond the side wall edges. The ends of the metal strips are unattached to one another.

In accordance with other aspects of the invention, in one embodiment, the upper end of the body includes an opening. In another embodiment, the body includes a lateral tear line located below the body upper end, with the opening mechanism located below the tear line.

In accordance with further aspects of the invention, during use, the ends of the metal strips are bent away from one another, the ends are pinched together and moved toward one another to cause the metal strips to bulge outward at their mid-section. This further causes the body side walls to separate so that the object may be inserted into the bag. When using a lateral tear line, the upper end of the body is first torn away along the lateral tear line.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

The present invention is a plastic bag for use in collection, processing, and manipulation of material samples taken for biological and industrial testing.

Figure 1:
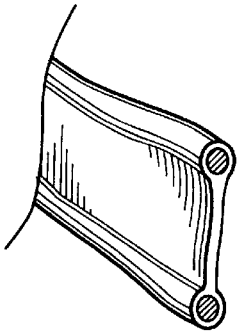
FIG. 1 is a perspective view of a sterile collection bag formed in accordance with the present invention.

Referring to FIG. 1, the bag 10 includes a body 12 formed of plastic or other known flexible, non-porous collection bag material. The body includes opposed side walls 14, 14' and an upper body end 16. Each side wall 14, 14' has an exterior surface and a center section. The interior of the body defines a sterile collection space for a sample object S to be placed.

In one embodiment, a lateral tear line 18 is located below the body upper end. The tear line is semi-perforated preferably using a laser beam, such that only a portion of the bag material is cut. By not actually cutting all the way through the bag material, the user can be assured that the interior of the bag is kept sterile. In another embodiment, the upper end of the body is not closed.

Figure 2:
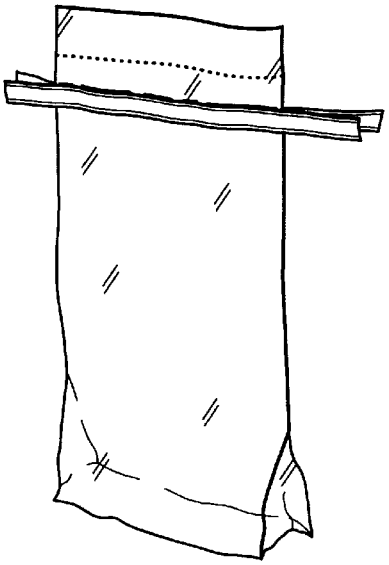
FIG. 2 is a detail view of the end of a tin tie opening mechanism used in the arrangement of FIG. 1.

An opening mechanism 20 is provided at a location below the tear line. The opening mechanism includes at least two flexible metal strips. In one embodiment, such strips are provided by two standard tin ties 22, 22'. Referring to FIG. 2, one embodiment of a tin tie includes a flat, flexible, elongate strip composed of a flexible upper metal wire 24 and a flexible lower metal wire 26. Both wires are covered by a bendable plastic 28. A flat region 30 of bendable plastic is provided between the wires as well. Other types of tin ties may be used, e.g., a two-sided flat paper strip with a single metal wire therebetween. The metal wires are flexible enough to be bent by most people and yet rigid enough to maintain the configuration to which they are bent until re-bent into a new configuration. Thus, the wire members are bendable, though somewhat stiff. The tin ties are conventional items, typically sold with coffee bags, saltine crackers, and the like.

Referring back to FIG. 1, each tin ties 22, 22' includes a first end 32, 32', a second end 34, 34', and a mid-section 36, 36'. The tin ties are attached to the side walls of the body and extend a small distance beyond the body's side edges. In one embodiment, the mid-section 36 of the tin tie is attached to the center of the side wall exterior surface. In another embodiment, the tin tie is attached to the side wall along the side wall's entire width. The attachment may be made using various method. In one arrangement, the tin ties are glued to the exterior surface of the side walls using a conventional adhesive.

The ends of the metal strips are not attached to one another so that during use the ends may be easily separated as described below. In one embodiment, one metal strip is made longer than the other metal strip so as to further facilitate separating its end with the other metal strip's corresponding end. Similarly, the metal strips may be made the same length, though attached to the bag body in an offset manner. The metal strips are attached to the side walls in an orientation generally parallel to the tear line. The strips are positioned parallel and opposite to one another.

Figure 3:
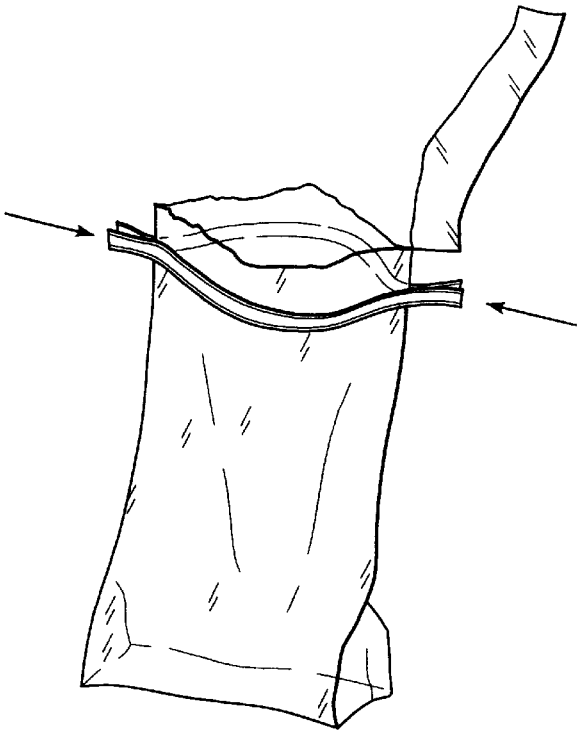
FIG. 3 is a perspective view of the embodiment of FIG. 1, illustrating the action used to open the bag.

Referring to FIG. 3, during use and if a tear line is provided, the operator tears off the upper end of the bag at the semi-perforated tear line. The operator separates the ends of the metal strips. Once separated, the ends are pinched toward each other to cause the bag to open at the tear line. Thus, the ends of the wire members serve as levers to pry open the bag. If necessary, the ends of the bag may be additionally pushed toward one another to further encourage the bag to open. Samples S are then placed in the interior of the sterile collection bag.

Figure 4:
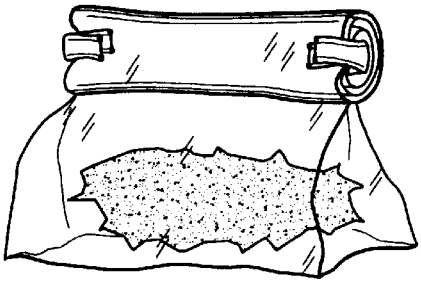
FIG. 4 is a perspective view of the embodiment of FIG. 1 in a closed configuration.
Figure 1:
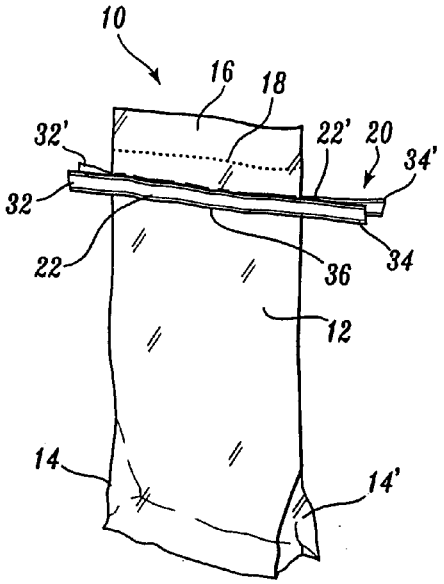
Figure 3:
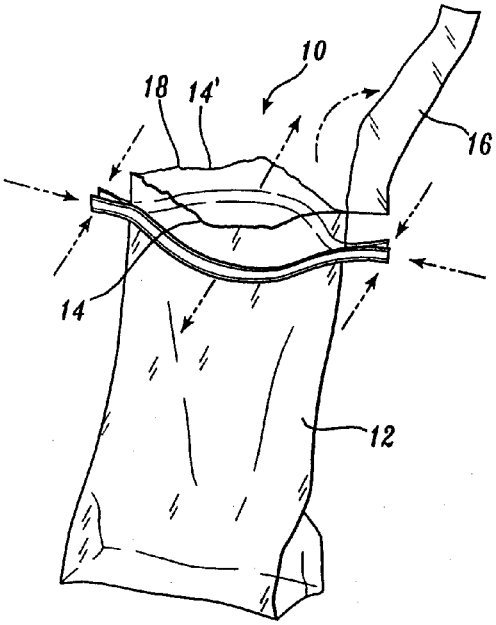
Figure 2:
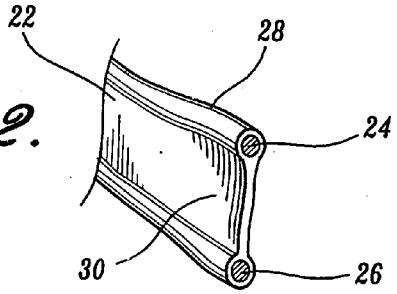
Figure 4:
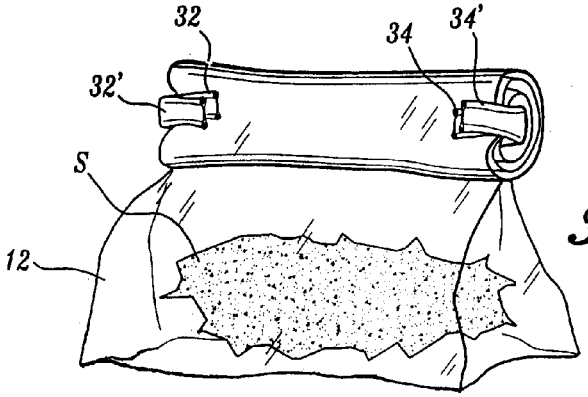

Referring to FIG. 4, once the bag is filled, the metal strips are pushed back together to close the opening. The metal strips are folded downward, on top of themselves, with the bag tightly rolling around the strips. Once a sufficient quantity of bag has been rolled, the ends of the metal strips are clamped along the side of the bag. The bag is then ready for transport.

As will be appreciated from the above, the present invention provides a sterile collection bag that is both easy to open and easy to manufacture. The assembly process requires only the correct placement and attachment of the tin ties to the bag side walls. The leverage action of the metal strips in opening the bag eliminates the need for pull tabs, further improving the ease of manufacture. In addition, the present invention reduces the number of punctures to the bag body during transport, since tin ties are covered with a non-sharp, plastic coating. Thus, the present invention bag better preserves the sterile integrity of the bag. The use of two metal strips also provides for a stronger closure of the bag opening.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A sterile collection bag comprising:

(a) a body including opposed side walls and an upper body end with a lateral opening, the body having a width, the body defining a sterile collection space for an object;

(b) an opening mechanism located near the upper end opening, the opening mechanism including first and second flexible metal strips each having a first end, a second end, and a mid-section; the first and second ends of the first metal strip being proximate with the first and second ends of the second metal strip respectively and forming first and second end pairs respectively, one metal strip being attached to each opposed side wall; the metal strips each being longer than the width of the body so as to extend beyond the side wall edges, the ends of the metal strips being unattached to one another;

wherein during use, the first ends of the metal strips are bent away from one another and the second ends are bent away from one another, the spaced-apart ends are pinched together and the first and second end pairs are pushed toward one another to cause the metal strips to bulge outward at their mid-section thereby further causing the body side walls to seperate the opening so that the object may be inserted into the bag.

2. The sterile collection bag of claim 1, wherein the end of at least one metal strip extends outwardly beyond its opposed proximate metal strip end so as to facilitate their separation during use.

3. The sterile collection bag of claim 1, wherein each metal strip is attached to a side wall by use of an adhesive placed between at least the metal strip mid-section and the side wall center section.

4. The sterile collection bag of claim 1, wherein each metal strip is attached to a side wall by use of an adhesive placed between the metal strip and the entire width of the side wall.

5. The sterile collection bag of claim 1, wherein the bag is closed by folding the upper end of the body about the metal strips and then pinching the ends of the metal strips back around the folded portions.

6. The sterile collection bag of claim 1, wherein the metal strips are encased in a plastic coating.

7. The sterile collection bag of claim 1, wherein the body includes a lateral tear line located near the upper body end; during use, the upper end of the body is torn away along the lateral tear line to form the opening.

8. The sterile collection bag of claim 1, wherein each metal strip is a tin tie.

9. The sterile collection bag of claim 8, wherein the end of at least one tin tie extends outwardly beyond its opposed proximate tin tie end so as to facilitate their separation during use.

10. The sterile collection bag of claim 8, wherein each tin tie is attached to the bag using an adhesive.

11. The sterile collection bag of claim 8, wherein the bag is closed by folding the upper end of the body about the metal strips and then pinching the ends of the metal strips back around the folded portions.

12. A sterile collection bag comprising:

(a) a body including opposed side walls and an upper body end, the body having a width, each side wall having an exterior surface and a center section, the body defining a sterile collection space for an object;

(b) a lateral tear line located below the body upper end; and (c) an opening mechanism located near the tear line, the opening mechanism including first and second flexible metal strips each having a first end, a second end, and a mid-section; the first and second ends of the first metal strip being proximate with the first and second ends of the second metal strip respectively and forming first and second end pairs respectively, the metal strips mid-section being attached to a side wall exterior surface and in an orientation parallel with the lateral tear line; the opposed ends of the metal strips being unattached to one another; the metal strips each being longer than the width of the body so as to extend beyond the side wall edges; the end of at least one metal strip extending outwardly beyond its opposed metal strip end;

wherein during use, the upper end of the body is torn along the lateral tear line, the first ends of the metal strips are bent away from one another and the second ends of the metal strips are bent away from one another, the spaced-apart ends are pinched together and the first and second end pairs are pushed toward one another to cause the metal strips to bulge outward at their mid-section thereby further causing the body side walls to separate and form an opening through which the object may be inserted into the bag.

13. A method of opening a sterile collection bag comprising:

(a) providing a bag including a body with opposed side walls and an upper end with an opening, the body having a width; and an opening mechanism including first and second flexible metal strips, each strip having a first and a second end, the first and second ends of the first metal strip being proximate with the first and second ends of the second metal strip respectively and forming first and second end pairs respectively, the metal strips being attached to the opposed side walls, the metal strips being longer than the width of the body so as to extend beyond the side wall edges, the ends of the metal strips being unattached to one another;

(b) bending the ends of the metal strips away from one another;

(c) pinching at least one of the spaced-apart ends of the metal strips together to cause the metal strips to bulge outward at their mid-section thereby further causing the body side walls to separate the opening so that an object may be inserted into the bag.

14. The method according to claim 13, wherein during use, the first and second end pairs of the metal strips are pushed toward one another to further facilitate opening of the bag.

15. The method according to claim 13, wherein the body includes a lateral tear line located near the upper body end; during use, the upper end of the body is torn away along the lateral tear line to form the opening.

16. The method according to claim 13, wherein the bag is closed by folding the upper end of the body about the metal strips and then pinching the ends of the metal strips back around the folded portions.

17. The sterile collection bag of claim 1, wherein each side wall includes an exterior surface and a center section, the metal strip mid-sections being attached to the side wall exterior surfaces.

18. The sterile collection bag of claim 1, wherein the metal strips are oriented parallel to the opening and parallel to one another.

19. The sterile collection bag of claim 13, wherein the metal strips are attached to opposed side walls in an orientation parallel to the opening and parallel to one another.

* * * * *

UNITED STATES PATENT AND TRADEMARK OFFICE

CERTIFICATE OF CORRECTION

PATENT NO. : 6,273,608 B1
DATED : August 14, 2001
INVENTOR(S) : N.R. Ward, Jr. et al.

It is certified that error appears in the above-identified patent and that said Letters Patent is hereby corrected as shown below:

Drawings,
Replace Figs. 1 - 4 with attached sheet 1.

Signed and Sealed this

Eighth Day of October, 2002

*Attest:*

*Attesting Officer*

JAMES E. ROGAN
*Director of the United States Patent and Trademark Office*

U.S. Patent Aug. 14, 2001 Sheet 1 of 1 6,273,608 B1